US006572410B1

(12) United States Patent
Volstorf et al.

(10) Patent No.: US 6,572,410 B1
(45) Date of Patent: Jun. 3, 2003

(54) CONNECTION HEADER AND SHIELD

(75) Inventors: James R. Volstorf, Mechanicsburg, PA (US); Johannes Maria Blasius van Woensel, Rosmalen (NL)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/079,339

(22) Filed: Feb. 20, 2002

(51) Int. Cl.[7] ..... H01R 13/648
(52) U.S. Cl. ..... 439/608; 439/607; 439/108
(58) Field of Search ..... 439/607, 608, 439/609, 107, 108, 101, 934

(56) References Cited

U.S. PATENT DOCUMENTS

| | | | | | |
|---|---|---|---|---|---|
| 3,587,028 | A | * | 6/1971 | Uberbacher | 439/608 |
| 4,624,515 | A | * | 11/1986 | Brush et al. | 439/608 |
| 4,959,626 | A | * | 9/1990 | Mouissie | 439/607 |
| 4,975,066 | A | | 12/1990 | Sucheski et al. | 439/63 |
| 4,975,069 | A | | 12/1990 | Fedder et al. | 439/101 |
| 5,015,802 | A | * | 5/1991 | Chi | 439/609 |
| 5,141,455 | A | | 8/1992 | Ponn | 439/620 |
| 5,174,770 | A | | 12/1992 | Sasaki et al. | 439/108 |
| 5,228,864 | A | | 7/1993 | Fusselman et al. | 439/108 |
| 5,451,174 | A | | 9/1995 | Bogursky et al. | 439/876 |
| 5,557,507 | A | * | 9/1996 | Koike et al. | 439/607 |
| 5,586,912 | A | * | 12/1996 | Eslampour et al. | 439/95 |
| 5,713,767 | A | | 2/1998 | Hanson et al. | 439/853 |
| 5,904,579 | A | | 5/1999 | McLean et al. | 439/63 |
| 6,065,998 | A | * | 5/2000 | Peloza | 439/108 |
| 6,220,896 | B1 | | 4/2001 | Bertoncini et al. | 439/608 |
| 6,379,186 | B1 | * | 4/2002 | Shi et al. | 439/607 |
| 6,435,913 | B1 | * | 8/2002 | Billman | 439/608 |
| 6,478,624 | B2 | * | 11/2002 | Ramey et al. | 439/608 |

* cited by examiner

*Primary Examiner*—Tho D. Ta
(74) *Attorney, Agent, or Firm*—Woodcock Washburn LLP

(57) ABSTRACT

A shield for an electrical connection header is provided. The shield comprises first, second, and third metal shield sections. Each of the first and second shield sections has open slots situated between the shield sections. The first and second sections are located substantially parallel to each other and have their corresponding slots substantially aligned with each other. The third metal shield sections are situated between the first and second sections and have an aperture for receiving a connection pin.

20 Claims, 5 Drawing Sheets

CONNECTION HEADER AND SHIELD

FIELD OF THE INVENTION

The invention relates to electrical connectors, and more particularly to a connection header and shield.

BACKGROUND OF THE INVENTION

In the manufacture of computers and other electronic apparatus, daughter circuit boards are commonly connected to mother circuit boards via modular electrical connectors, typically comprising a receptacle and a header. A daughter board typically electrically and mechanically connects to a receptacle, which in turn electrically and mechanically connects to a mother board (or backplane). The modular electrical connectors connect a number of signal wires to a board which typically includes rows and columns of connection holes with connection pins disposed therein.

As miniaturization becomes more prevalent, the number of signal connections in a given area increases. This results in an increased susceptibility to electrical interference from cross talk. Accordingly, to reduce the risk of cross talk between the signal connections, electrical connectors are often equipped with shielding to attempt to shield each signal from neighboring and nearby signals.

Shields are typically connected at one end to a ground plane and are also electrically and mechanically connected to ground connection pins at various locations in the connector. The connection between ground connection pins and the shield is typically a press fit connection. Further, there is typically one shield per column of conductors. While such a design provides acceptable shielding, there is still room for improvement in the manufacturabiliy and maintainability aspects of such a shield.

SUMMARY OF THE INVENTION

A shield for an electrical connection header is provided. The shield comprises first, second, and third metal shield sections. Each of the first and second shield sections has open slots situated between the shield sections. The first and second sections are located substantially parallel to each other and have their corresponding slots substantially aligned with each other. The third metal shield sections are situated between the first and second sections and have an aperture for receiving a connection pin.

Each shield section, each slot, and each aperture may be substantially rectangular. The first and second shield sections may comprise a projection for securing the shield to a housing. The projection is substantially coplanar with the first or second shield section. Each third metal section may comprise a spring loaded finger biased towards the center of the aperture of the third section, wherein the spring loaded finger is for electrical connection to a ground connection pin.

The shield may comprise a connecting tab extending from an end of the shield and may have a distal end for electrically connecting the shield to a spring.

A connection header is also provided. The connection header comprises a housing having holes arranged in rows and columns and shields located along every other column. Each shield comprises first, second, and third metal shield sections. Each of the first and second shield sections has open slots situated between the shield sections. The first and second sections are located substantially parallel to each other and have their corresponding slots substantially aligned with each other. The third metal shield sections are situated between the first and second sections and have an aperture for receiving a connection pin.

The housing may comprise a first and second substantially rectangular side section and a substantially rectangular middle section connected between the two side sections. The middle section may comprise holes arranged in columns and rows for receiving connections pins. The housing may be a dielectric. The housing may be a plastic.

A column of connection pins may comprise, in order, a first, second and third connection pin, where the first connection pin is a ground line and the second and third connection pins are signal lines. The first connection pin is electrically connected to the shield. The second and third connection pins may be a differential pair. The first connection pin may be connected to a spring loaded finger of the shield.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF ILLUSTRATIVE EMBODIMENTS

Figure 1:
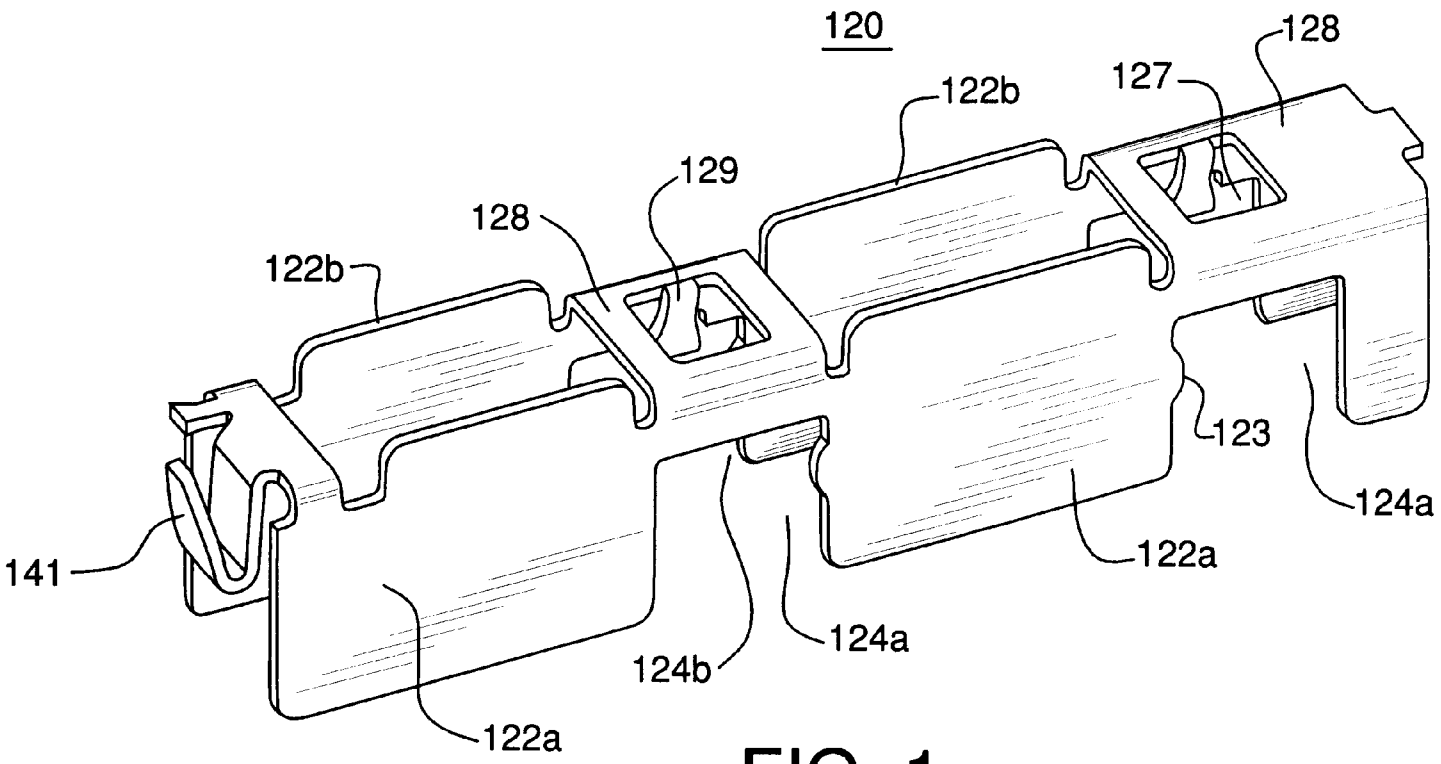
FIG. 1 is a perspective view of an illustrative shield, in accordance with an embodiment of the invention.

Certain terminology may be used in the following description for convenience only and is not considered to be limiting. For example, the words "left", "right", "upper", and "lower" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

As shown in FIG. 1, shield 120 comprises first metal shield sections 122*a*, second metal shield sections 122*b*, and third metal shield sections 128.

First metal shield sections 122*a* have first open slots 124*a* situated between first metal shield sections 122*a*. Each first metal shield section 122*a* is substantially rectangular and is vertically oriented; however, each first section 122*a* may be an shape suitable for connection to a header. Each open slot 124*a* is substantially rectangular; however, open slots 124*a* may take various shapes. Each first metal section 122*a* may include one or more projections 123 for securing first metal shield section 122*a* to a header, described in more detail below.

Second metal shield sections 122*b*, similar to first metal shield sections 122*a*, have open slots 124*b* situated between second metal shield sections 122*b*. Further, second metal sections 122*b* are located substantially parallel to first metal shield sections 122*a* with first open slots 124*a* substantially aligned with second open slots 124*b* and first metal shield sections 122*a* substantially aligned with second metal shield sections 122*b*.

Third metal shield sections 128 each includes an aperture 127 for receiving a ground connection pin. Third metal shield sections 128 are substantially rectangular and horizontally oriented and have a substantially rectangular aperture 127; however, third metal shield sections 128 may be any shape to connect between first metal shield sections 122*a* and second metal shield sections 122*b*. Further, aperture 127 may be any shape to receive ground connection pins. Third metal shield sections 128 are situated substantially between and connected to first metal shield sections 122*a* and second metal shield sections 122*b* and are located proximate to one of first open slots 124*a* and one of second open slots 124*b*.

Third metal shield section 128, at one end, is connected substantially perpendicular to first metal shield section 122*a* and, at an opposing end, is connected substantially perpendicular to second metal shield section 122*b*, forming a u-shape. This connection on opposing sides of third metal shield section 128 provides rigidity to third metal section 128. As such, a ground connection pin may be placed within aperture 127 with reduced risk of deforming third metal shield section 128 and shield 120. Therefore, slight connection pin misalignment in manufacturing may be better tolerated.

Third metal shield section 128 comprises a spring loaded finger 129. Spring loaded finger 129 is biased towards the center of aperture 127 for making electrical contact with a corresponding ground connection pin. When assembled in a header, spring loaded finger 129 makes contact with a ground connection pin. Because the connection is spring biased instead of press fit, ground connection pins are replaceable, more ground connection pin movement may be acceptable, and slight connection pin misalignment in manufacturing may be better tolerated.

Projection 123 extends from some of first and second metal shield sections 122*a*, 122*b*. Projection 123 provides a detent mechanism for securing shield 120 to a header. Projection 123 may provide a stronger connection between shield 120 and a header, thereby possibly improving manufacturability. Further, because shield 120 includes two metal shield sections (i.e., first metal shield sections 122*a* and second metal shield sections 122*b*) that connect to a header, the connection between shield 120 and the header may be stronger than a shield with only one metal shield section that connects to the header.

Figure 2:
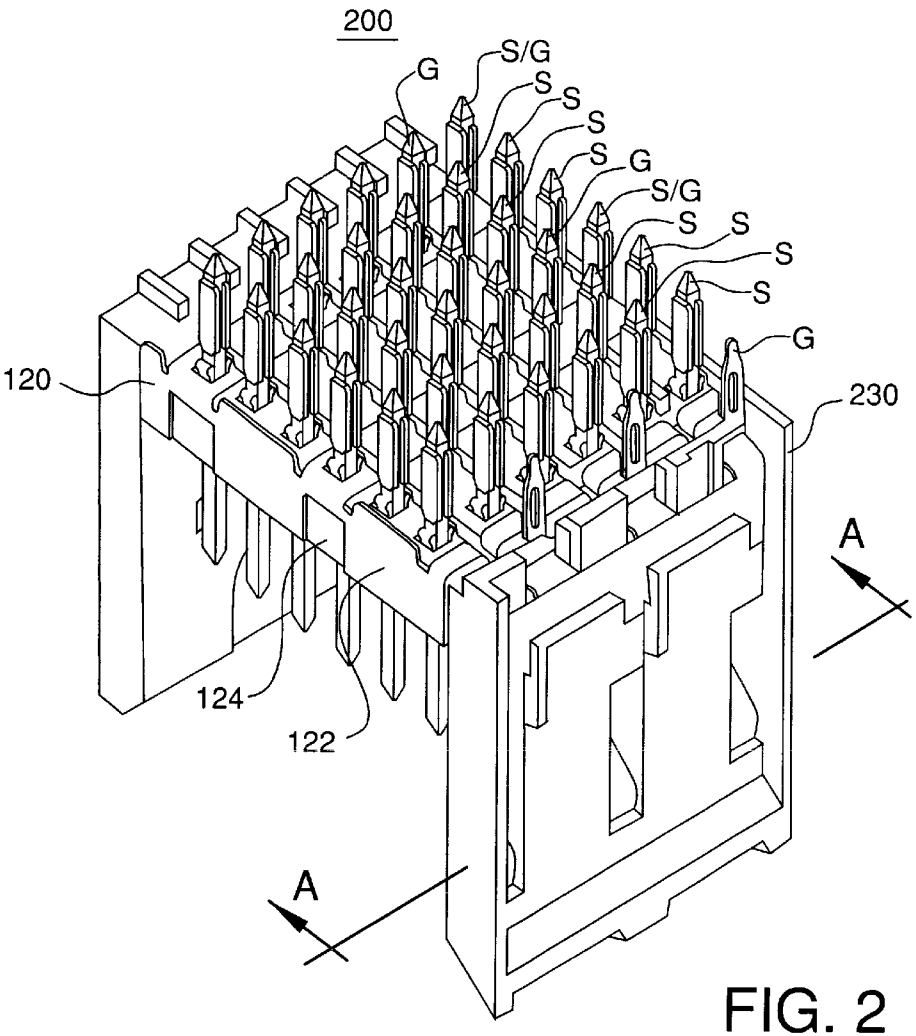
FIG. 2 is a perspective view of an illustrative header including the shield of FIG. 1, in accordance with an embodiment of the invention.

A header is disclosed in U.S. Pat. No. 6,220,896, entitled "Shielded Header", issued Apr. 24, 2001, and incorporated by reference herein in its entirety. FIG. 2 shows an illustrative header 200. Header 200 may also have a conventional footprint, allowing it to be used for conventional connectors. Header 200 includes housing 230, a plurality of shields 120, a plurality of signal connection pins S, and a plurality of ground connection pins G.

Housing 230 comprises two substantially rectangular side sections and a substantially rectangular middle section connected between the two side sections. The middle section comprises a plurality of holes for receiving connections pins. The connections pins may be signal connection pins S or ground connection pins G. The holes are arranged into columns. While a header having six columns is illustrated, the header may have twelve columns of eight holes or other configurations. It should also be understood that one row of connection pins may be grounded to a metallic shield on the receptacle. Alternatively, there may be any number of rows, preferably at least five rows. Also, there may be any number of columns.

Figure 5:
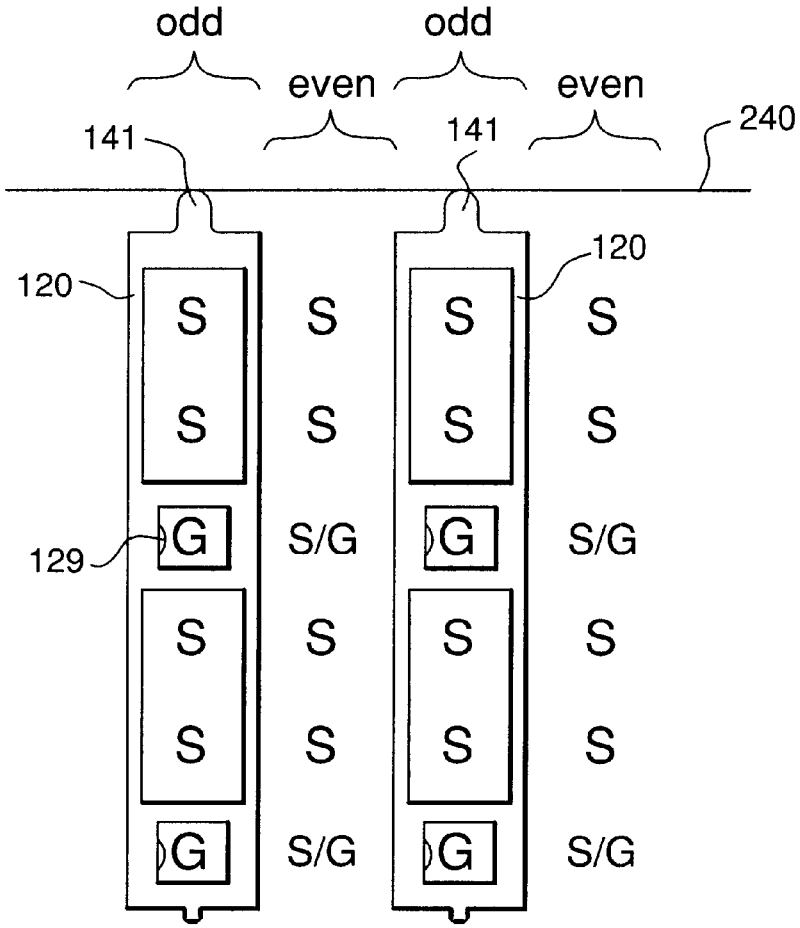
FIG. 5 is a top diagrammatic view of a portion of the connector of FIG. 2.

To better illustrate the columns and rows, FIG. 5 is a diagrammatic view of shields 120 and connection pins as located on housing 230. As shown in FIG. 5, columns are divided into even and odd columns. Odd columns include a shield 120 disposed along the length of the column. Even columns are shown without a shield 120, although, even columns may include a shield 120. An odd column comprises, respectively, a ground connection pin G, a pair of signal connection pins S, another ground connection pin G, another pair of signal connection pins S, and a ground connection pin G connected to tab 141. An even column comprises, respectively, a first connection pin that may be a ground G or a signal S connection pin, a pair a signal connection pins S, a second connection pin that may be a ground G or a signal S connection pin, another pair of signal connection pins S, and a ground connection pin G connected to tab 141. Ground connection pins G, mate with a ground contacts (not shown) on the receptacle. Signal connection pins S mate with signal contacts (not shown) on the receptacle. Typically, a pair of signal connection pins S are differential pair signals.

Shields 120 provide electrical separation between signals. As can be seen, in an odd column, a pair of signal connection pins S are surrounded on two opposing sides by metal shield sections 122*a*, 122*b* of shield 120, and on the other two opposing sides (or ends) by ground connection pins G. This provides electrical separation between pairs of signal connection pins S that affect the electromagnetic field around each signal connection pin S so as to reduce cross talk between adjacent signal connection pins S. Because shields include first and second metal shield sections 122*a*, 122*b*, one shield 120 can be used for every two columns of connection pins.

Moreover, if only one shield 120 is used for every two columns of connection pins (i.e., on odd columns), even columns may comprise all signal connection pins. Because more connection pins can be used as signal connection pins, signal density can be increased. Alternatively, even columns may comprise ground connection pins G, similar to the odd columns.

Tab 141 connects shield 120 to groundspring element 240 which is also in contact with shield section 42. Tab 141 further enhances grounding and cross talk reduction by allowing ground current from shield 120 to be further distributed to groundspring element 240.

Figure 3:
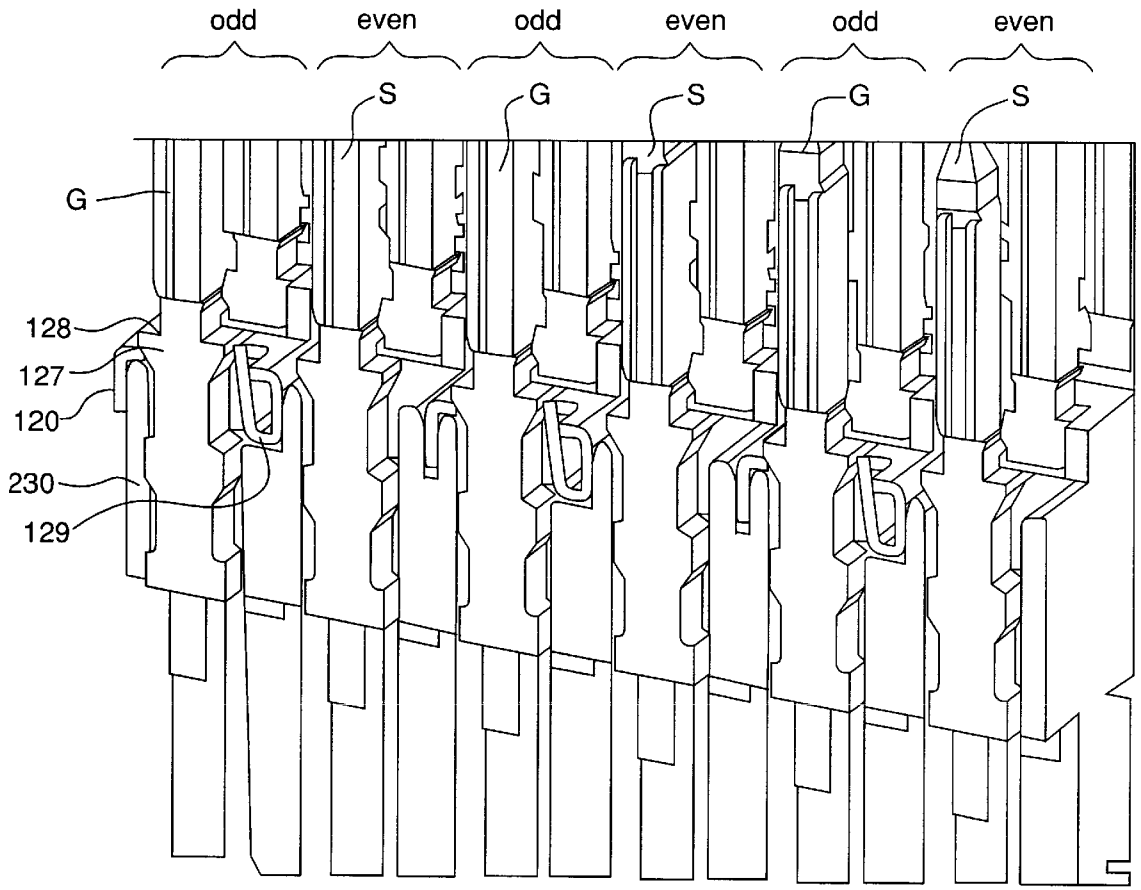
FIG. 3 is a cut-away perspective view of the header of FIG. 2, along line A.

To illustrate a connection pin located in housing 230 as well as a configuration employing shield 120, FIG. 3 shows a cut-away perspective view of header 200. As shown in FIG. 3, each odd column includes a shield 120 along the length of the column. Shield 120 is located on a substantially rectangular portion of an odd column of housing 230. Apertures 127 are located proximate to every third hole in an odd column for receiving a ground connection pin G. Ground connection pin G is located in a hole of housing 230 and in aperture 127.

Figure 4A:
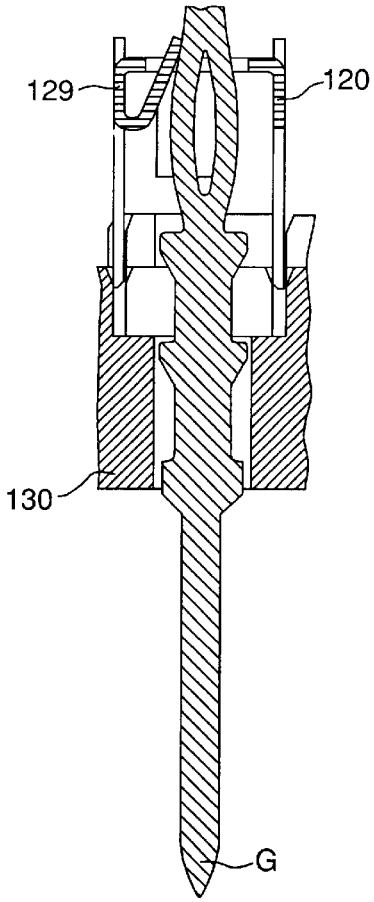
FIG. 4*a* is a cross-sectional view of a portion of the header of FIG. 1, illustrating connection of a ground connection pin to the shield.
Figure 4B:
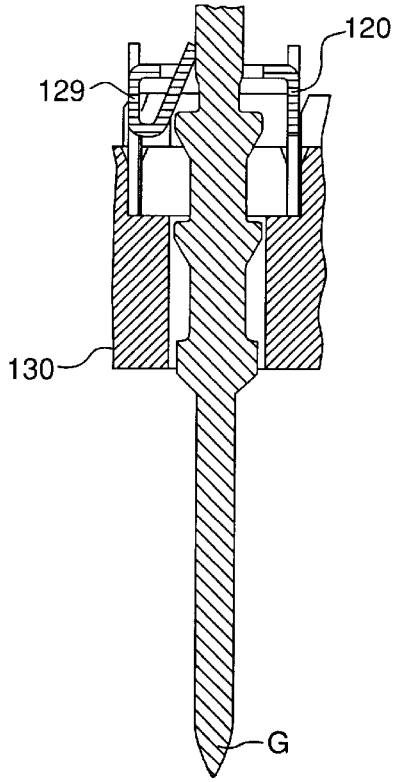
FIG. 4*b* is another cross-sectional view of a portion of the header of FIG. 1, illustrating connection of a ground connection pin to the shield.

Spring loaded finger 129 is biased towards the center of aperture 127 and contacts ground connection pin G, thereby electrically connecting ground connection pin G to shield 120, which is in turn electrically connected to groundspring element 240. Ground connection pin G is mechanically secured to housing 230 via an interference fit between the hole in housing 230 and ground connection pin G. FIGS. 4*a* and 4*b* show connection of ground connection pin G to shield 120 via spring loaded finger 129 with the shield in various positions.

Therefore, it can be seen that an improved shield and connection header is provided. Shield 120 comprises first metal shield sections 122*a* and second metal shield sections 122*b* that may provide a stronger connection between shield 120 and header 200, thereby possibly improving manufacturability. Shield 120 may further comprise a projection 123 that may provide a stronger connection between shield 120 and header 200, thereby possibly improving manufacturability. Shield 120 may further comprise a spring loaded finger 129 that may allow more ground connection pin movement and slight ground connection pin misalignment in manufacturing.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed:

1. A shield for an electrical connection header, the shield comprising:

a plurality of first metal shield sections having a plurality of first open slots situated between the first shield sections;

a plurality of second metal shield sections having a plurality of second open slots situated between the second shield sections, the first sections located substantially parallel to the second sections, the first open slots substantially aligned with the second open slots; and a plurality of third metal shield sections, each third section having an aperture, the third sections being situated substantially between and connected to the first sections and the second sections, each third metal shield section located proximate to one of the first open slots and one of the second open slots.

2. The shield as recited in claim 1, wherein each shield section is substantially rectangular.

3. The shield as recited in claim 1, wherein each slot is substantially rectangular.

4. The shield as recited in claim 1, wherein each aperture is substantially rectangular.

5. The shield as recited in claim 1, wherein at least one of the first and second shield sections comprises a projection from and substantially coplanar with the at least one shield section, the projection for securing the shield to a housing.

6. The shield as recited in claim 1, further comprising a connecting tab extending from an end of the shield and having a distal end for electrically connecting the shield to a spring.

7. The shield as recited in claim 1, wherein each third metal section comprises a spring loaded finger biased towards the center of the aperture of the third section, the spring loaded finger for electrical connection to a ground connection pin.

8. A header for interconnecting electrical components, the header comprising:

a housing comprising a plurality of holes arranged in rows and columns; and a plurality of shields, one shield located along every other column, each shield comprising:

a plurality of first metal shield sections having a plurality of first open slots situated between the first shield sections;

a plurality of second metal shield sections having a plurality of second open slots situated between the second shield sections, the first sections located substantially parallel to the second sections, the first open slots substantially aligned with the second open slots, the first and second shield sections disposed on opposing sides of one of the columns; and a plurality of third metal shield sections, each third section having an aperture, the third sections being situated substantially between and connected to the first sections and the second sections, each third metal shield section located proximate to one of the first open slots and one of the second open slots.

9. The header as recited in claim 8, wherein each shield further comprises a connecting tab extending from an end of the shield and having a distal end for electrically connecting the shield to a spring.

10. The header as recited in claim 8, wherein the housing comprises:

a first and second substantially rectangular side section; and a substantially rectangular middle section connected between the two side sections, the middle section comprising a plurality of holes arranged in columns and rows for receiving connections pins.

11. The header as recited in claim 8, wherein the housing comprises a dielectric.

12. The header as recited in claim 8, wherein the housing comprises a plastic.

13. The header as recited in claim 8, wherein in each column, is a repeating pattern of two signal connection pins followed by a ground connection pin.

14. The header as recited in claim 8, wherein in each odd column, is a repeating pattern of two signal connection pins followed by a ground connection pin, and in each even column, is a repeating pattern of signal connection pins.

15. The header as recited in claim 8, wherein at least one of the first and second shield sections comprises a projection from and substantially coplanar with the at least one shield section, the projection secured to the housing.

16. The header as recited in claims 15, wherein the projection is coupled to the housing in an interference fit.

17. The header as recited in claim 8, wherein each third metal section comprises a spring loaded finger biased towards the center of the aperture of the third section, the spring loaded finger for electrical connection to a ground connection pin.

18. The header as recited in claim 17, further comprising:

at least one column of connection pins aligned with one of the shields, the column of connection pins comprising:

a first, second and third connection pin, the first connection pin is a ground line, the second and third connection pins are signal lines, the first connection pin is electrically connected to the shield, and the second connection pin is positioned in the column in interposed relation between the first and third connection pin; and a fourth and fifth connection pin that are signal lines and the fourth connection pin is positioned adjacent the first connection pin in opposed relation to the second connection pin and the fifth connection pin is positioned in outward adjacent relation to the fourth connection pin.

19. The header as recited in claim 18, wherein the second and third connection pins are differential pairs, the fourth and fifth connection pins are differential pairs and the first connection pin is interposed between the differential pairs.

20. The header as recited in claim 19, wherein the first connection pin is connected to one of the spring loaded fingers.

* * * * *